US005236822A

United States Patent [19]

Riecke et al.

[11] Patent Number: 5,236,822

[45] Date of Patent: Aug. 17, 1993

[54] METHOD AND COMPOSITION FOR HARDENING GELATIN

[75] Inventors: Edgar E. Riecke, Pittsford; Derek D. Chapman, Rochester; Chung Y. Chen, Rochester; Kenneth G. Harbison, Rochester, all of N.Y.

[73] Assignee: Eastman Kodak Company, Rochester, N.Y.

[21] Appl. No.: 770,393

[22] Filed: Oct. 3, 1991

[51] Int. Cl.[5] ..... G03C 1/30

[52] U.S. Cl. ..... 430/623; 430/621; 430/642; 530/354; 530/409; 106/125

[58] Field of Search ..... 430/621, 623, 642; 530/354, 409; 106/125

[56] References Cited

U.S. PATENT DOCUMENTS

| | | | |
|---|---|---|---|
| 3,951,940 | 4/1976 | Ballantine et al. | 430/623 |
| 4,063,952 | 12/1977 | Himmelmann et al. | 430/422 |
| 4,612,280 | 9/1986 | Okamura et al. | 430/621 |
| 4,877,724 | 10/1989 | Chen et al. | 430/621 |

FOREIGN PATENT DOCUMENTS

| | | | |
|---|---|---|---|
| 162308 | 11/1985 | European Pat. Off. . | |
| 63-135935 | 6/1988 | Japan | 430/623 |

*Primary Examiner*—Marion E. McCamish
*Assistant Examiner*—Janis L. Dote
*Attorney, Agent, or Firm*—Edith A. Rice

[57] ABSTRACT

A method for hardening gelatin which comprises using as a hardening agent a compound represented by formula (I):

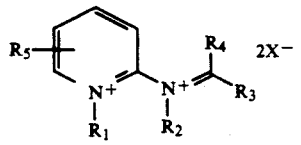

wherein $R_1$, when taken along, may be alkyl of 1 to 20 carbon atoms, aralkyl of from 7 to 20 carbon atoms, aryl of from 6 to 20 carbon atoms, and alkenyl of from 2 to 20 carbon atoms. $R_1$ and $R_2$ can also combine with each other to form a heterocyclic ring of 5 to 8 atoms. The $R_1$-$R_2$ ring contains the nitrogen atoms to which $R_1$ and $R_2$ are attached, and may also contain an additional nitrogen atom. $R_2$ and $R_3$ can combine to form either a 5 or 6 membered ring. The $R_2$-$R_3$ ring contains the nitrogen atom to which $R_2$ is attached, and may also contain one or two additional nitrogen atoms. $R_4$ may be hydrogen or alkyl of 1 to 4 carbon atoms. $R_5$ may be hydrogen or one or more substituents at any of positions 3 through 6 on the pyridine ring, including alkyl of 1 to 20 carbon atoms, aryl of from 6 to 20 carbon atoms, aralkyl of from 7 to 20 carbon atoms, or alkenyl of from 2 to 20 carbon atoms, alkoxy of 1 to 20 carbon atoms, aryloxy of from 6 to 20 carbon atoms, carboxy, halogen, nitro, or sulfo. $R_5$ may be in a fused ring structure such as in quinoline. $X^-$ represents an anion or an anionic portion of compounds of formula (I) effectively harden gelatin with little or no afterhardening. These compounds are useful in hardening gelatin in photographic elements.

4 Claims, No Drawings

METHOD AND COMPOSITION FOR HARDENING GELATIN

FIELD OF THE INVENTION

This invention relates to a hardening method for gelatin which uses an improved hardening agent, and more particularly to a hardening method for gelatin which is useful for silver halide photographic materials.

BACKGROUND OF THE INVENTION

Gelatin is commonly used as a binder for various photographic materials. Quite often, several layers in a photographic element, such as light-sensitive silver halide layers, overcoat layers, filter layers, interlayers, antihalation layers, backing layers, film base subbing layers, antihalation layers and baryta layers contain gelatin as a major component.

Photographic materials are generally processed in aqueous processing solutions. Such processing results in excessive swelling and loss of strength of the gelatin binder unless the gelatin has been hardened. Also, if the processing solution is maintained at a warm temperature, such as 40° C., the gelatin binder can dissolve, causing the layers of the element to disintegrate, unless the gelatin has been hardened.

A number of compounds have been used to harden gelatin. Typical examples of hardeners include formaldehyde and aldehyde compounds as described in U.S. Pat. No. 3,232,764, active esters as described in U.S. Pat. No. 3,542,558, compounds that contain a reactive halogen atom as described in U.S. Pat. No. 3,951,940, activated olefins as described U.S. Pat. No. 3,642,486, aziridine compounds as described in U.S. Pat. No. 3,017,280, epoxy compounds as described in 3,091,537, inorganic hardening agents such as chromium alum and zirconium sulfate and others well-known in the art. These compounds harden or crosslink gelatin, thus increasing its mechanical strength and reducing the swellability and solubility of the gelatin in aqueous processing solutions.

The above-described hardening compounds are, however, subject to a number of disadvantages. In some cases an exceedingly long time is required after a layer is cast and dried to achieve the desired degree of gelatin hardening; thereby requiring photographic elements containing gelatin hardened with those compounds to be aged for an extended time while the hardening process is completed. In other words, these hardeners exhibit after hardening. Additionally, a number of compounds exhibit adverse effects on the photographic properties of elements in which they are used. Such adverse effects can include an increase in fog or a reduction in light sensitivity or photographic speed.

In order to avoid the time and expense of keeping large quantities of gelatin-containing photographic elements for long periods while the hardening process is completed, a number of socalled fast-acting hardeners have been described in the art. For example, U.S. Pat. No. 4,063,952 describes a carbamoylpyridinium salt hardening compound, European Patent Application 162,308 describes a chloroformamidinium hardener and U.S. Pat. No. 4,612,280 describes an N-succinimidyloxyformamidinium hardener. These hardeners, however, suffer from a number of problems. Some of these hardeners exhibit after hardening. Others have severe handling difficulties due to their hygroscopic nature and/or to poor hydrolytic stability. Also, some of these hardeners adversely affect either the physical properties of photographic elements in which they are used (e.g., tackiness) or their sensitometric properties (e.g., speed loss). These problems are often aggravated by the fact that relatively large amounts of hardener are often required to achieve the desired hardening effect, leading to relatively large amounts of sometimes deleterious by-products.

It is therefore desirable to provide a hardener that effectively hardens gelatin in a short period of time, while substantially avoiding or reducing many of the above-described adverse effects. It is toward that end that the present invention is directed.

In the photographic arts, there is an abiding interest in the provision of new classes of hardener compounds such as provided herein. In view of this interest and in view of the hardening properties of the compounds of this invention, it is believed that this invention represents a substantial contribution to the art.

Ballantine et al., U.S. Pat. No. 3,951,940 describes N-alkyl-2-halopyridinium salts and alkylene-N,N'-[bis(2-halopyridinium)] salts for hardening gelatin, shown in formulas (II) and (III).

(II)

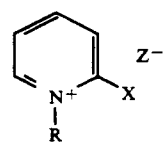

(III)

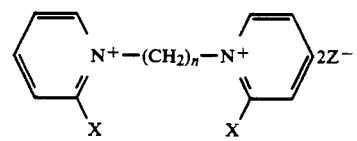

These compounds have a 2-pyridylium moiety bonded to a halogen atom. They do not suggest the compounds of this invention, in which a 2-pyridylium moiety is bonded to a nitrogen which carries a positive charge. The Ballantine et al. compounds contain a halogen on the pyridinium ring that is released upon reaction with gelatin, which may cause adverse photographic effects in photographic elements that contain silver halide. Such halogen need not be present in the compositions of this invention. Furthermore, when halogen is present as a substituent on the 2-pyridylium moiety in compositions of this invention, the halogen is deliberately not conjugated with the quarternary ring nitrogen and is therefore not released during reaction of these compounds with gelatin.

Chen et al., U.S. Pat. No. 4,877,724, discloses dicationic ethers as useful hardeners. The hardeners of this invention are decidedly different from those within Chen et al., since the compounds of this invention do not have the ether moiety that is within the hardeners of Chen et al..

SUMMARY OF THE INVENTION

The present invention provides rapid hardening of gelatin with relatively small amounts of hardener while reducing many of the adverse side-effects, such as after hardening or adverse effects on photographic properties. This is accomplished by combining gelatin with a compound of either formula (1):

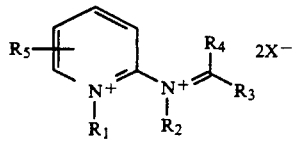

wherein $R_1$, when taken alone, is selected from alkyl groups of 1 to 20 carbon atoms, aryl groups of from 6 to about 20 carbon atoms, aralkyl groups of from 7 to about 20 carbon atoms, or alkenyl groups of from 2 to about 20 carbon atoms; $R_1$ when taken together with $R_2$ form a heterocyclic ring of 5 to 8 atoms, which may include one nitrogen in addition to the two nitrogen atoms in said formula; $R_2$ and $R_3$ together form a 5 or 6 membered ring which may include one or two nitrogen atoms in addition to the nitrogen to which $R_2$ is attached; such that the above-described $R_1$–$R_2$ and $R_2$–$R_3$ ring atoms other than nitrogens are carbons; $R_4$ is selected from hydrogen or alkyl groups of from 1 to about 20 carbon atoms; $R_5$ is selected from hydrogen or one or more substituents at any of positions 3 through 6 on the pyridine ring, selected from the group consisting of alkyl of from 1 to about 20 carbon atoms, aryl of from 6 to about 20 carbon atoms, aralkyl of from 7 to about 20 carbon atoms, or alkenyl of from 2 to about 20 carbon atoms, alkoxy of from 1 to about 20 carbon atoms, aryloxy of from 6 to about 20 carbon atoms, carboxy, halogen, nitro, or sulfo; and $X^-$ represents an inert anion or an anionic portion of said compound, forming an intramolecular salt, with the proviso that the anion or anionic portion does not interfere with the hardening process.

DETAILED DESCRIPTION

Compound of the invention according to formula (I) are described in further detail below.

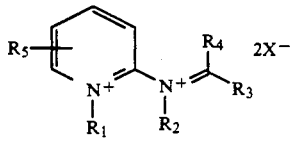

In this formula, $R_1$ represents alkyl, aralkylm, aryl, or alkenyl. $R_2$ together with $R_3$ combine to form a 5 or 6 membered ring that may contain one or two additional nitrogen atoms. In additional to the $R_2$–$R_3$ ring structure, $R_1$ can be taken together with $R_2$ to form a ring structure. $R_4$ may be hydrogen or alkyl. $R_5$ may be hydrogen, alkyl, aryl, aralkyl, alkenyl, alkoxy, aryloxy, carboxy, halogen, nitro, or sulfo.

Preferably, $R_1$ may be alkyl of 1 to 20 carbon atoms (e.g., methyl, ethyl, butyl, 2-ethylhexyl, or dodecyl), aralkyl of from 7 to 20 carbon atoms (e.g., benzyl, phenethyl), aryl of from 6 to 20 carbon atoms (e.g., phenyl, naphthyl), or alkenyl of from 2 to 20 carbon atoms (e.g., vinyl, propenyl).

$R_1$ and $R_2$ can also preferably combine with each other to form a heterocyclic ring of 5 to 8 atoms. The $R_1$–$R_2$ ring contains the nitrogen atoms to which $R_1$ and $R_2$ are attached, and may also contain one additional nitrogen atom.

$R_2$ and $R_3$ combine to form either a 5 or 6 membered ring. The $R_2$–$R_3$ ring contains the nitrogen atom to which $R_2$ is attached, and may also contain one or two additional nitrogen atoms. Examples of the $R_2$–$R_3$ ring are pyridine, imidazole, pyrazole, and triazole.

Preferably, R4 may be hydrogen or alkyl of 1 to 4 carbon atoms (e.g., methyl, ethyl, or isopropyl).

$R_5$ may be hydrogen or one or more substituents at any of positions 3 through 6 on the pyridine ring. Examples of such substituents include alkyl of 1 to 20 carbon atoms (e.g., methyl, ethyl, butyl, 2-ethylhexyl, or dodecyl), aryl of from 6 to 20 carbon atoms (e.g., phenyl, naphthyl), aralkyl of from 7 to 20 carbon atoms (e.g., benzyl, phenethyl), or alkenyl of from 2 to 20 carbon atoms (e.g., vinyl, propenyl), alkoxy (e.g., methoxy or ethoxy), aryloxy (e.g., phenoxy), carboxy, halogen (e.g., fluoro, chloro, or bromo), nitro, or sulfo.

$X^-$ represents an anion or an anionic portion of compound (I) to form an intramolecular salt (zwitterion). Any anion that forms a salt compound and which does not interfere with the hardening process can be used. Preferred anions include sulfonate ion such as methylsulfonate, p-toluenesulfonate, trifluoromethylsulfonate or 1,3-propylenedisulfonate, and tetrafluoroborate, pentafluorophosphate, and perchlorate. Alternatively, $X^-$ can be an anionic portion of $R_1$ of compound (I). Preferred anionic substituents to form an intramolecular salt include alkylsulfonates such as sulfatoethyl, sulfatopropyl, and sulfatobutyl.

In addition to the above-described alkyl, aralkyl, aryl, alkenyl, and ring systems, also useful are substituted alkyl, aralkyl, aryl, alkenyl, and ring systems. Useful substituents include halogen, alkoxy of from 1 to 20 carbon atoms, aryloxy of from 6 to 20 carbon atoms, carboxy, sulfo, N,N-disubstituted carbamoyl, N,N-disubstituted sulfamoyl, and other groups known to those skilled in the art that do not prevent the compounds from functioning as hardeners according to the invention.

Examples of compounds of formula (I) are shown below in Table I.

TABLE I

| Compound | Structure |
|---|---|
| (1) | 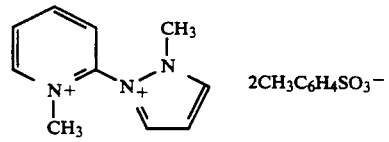 |
| (2) | 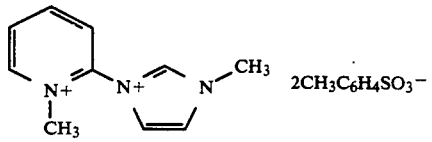 |
| (3) | 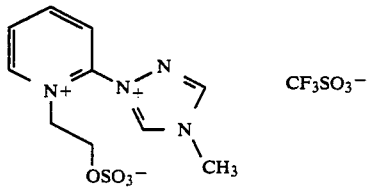 |

TABLE I-continued

| Compound | Structure |
|---|---|
| (4) | 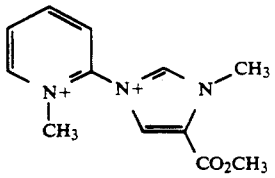 $2p\text{-}CH_3C_6H_4SO_3^-$ |
| (5) | 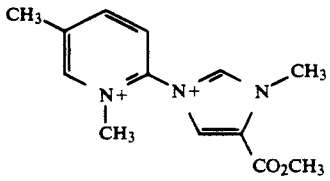 $2p\text{-}CH_3C_6H_4SO_3^-$ |
| (6) | 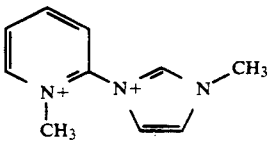 $2BF_4^-$ |
| (7) | 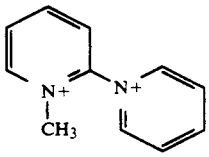 $2CF_3SO_3^-$ |
| (8) | 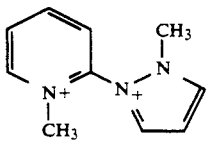 $2BF_4^-$ |
| (9) | 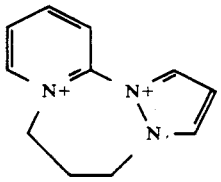 $2BF_4^-$ |
| (10) | 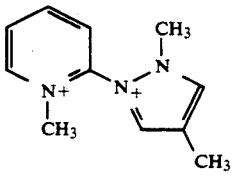 $2BF_4^-$ |
| (11) | 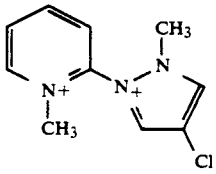 $2CF_3SO_3^-$ |

TABLE I-continued

| Compound | Structure |
|---|---|
| (12) | 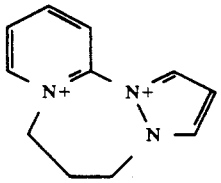 $-OSO_3(CH_2)_3OSO_3^-$ |
| (13) | 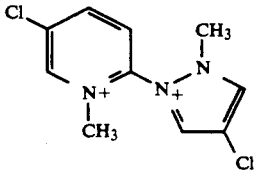 $2CF_3SO_3^-$ |
| (14) | 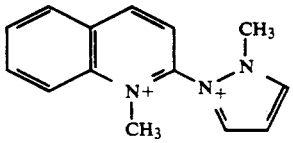 $2CF_3SO_3^-$ |
| (15) | 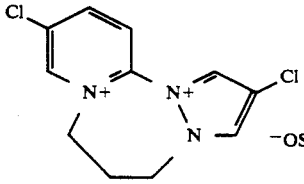 $-OSO_3(CH_2)_3OSO_3^-$ |
| (16) | 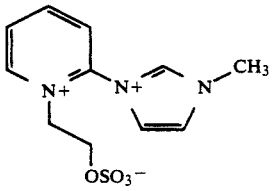 $CF_3SO_3^-$ |
| (17) | 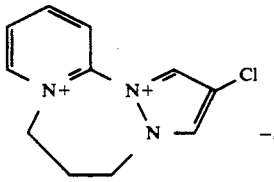 $-OSO_3(CH_2)_3OSO_3^-$ |
| (18) | 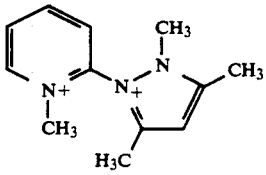 $2BF_4^-$ |

The compounds of formula (I) can be made by techniques known to those skilled in the chemical synthesis art. The preparation of compounds of formula (I) is further described in the schemes given below and in the synthesis examples.

Hardeners used in this invention can be made as illustrated in the following reaction schemes.

Scheme 1

-continued

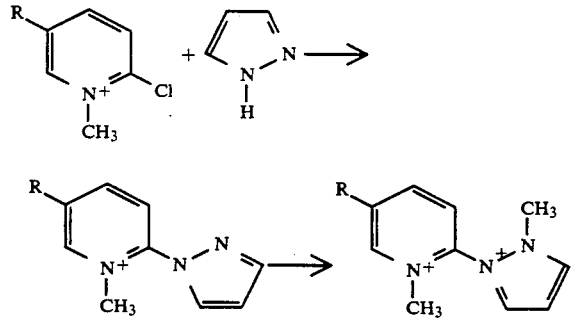

Scheme 2

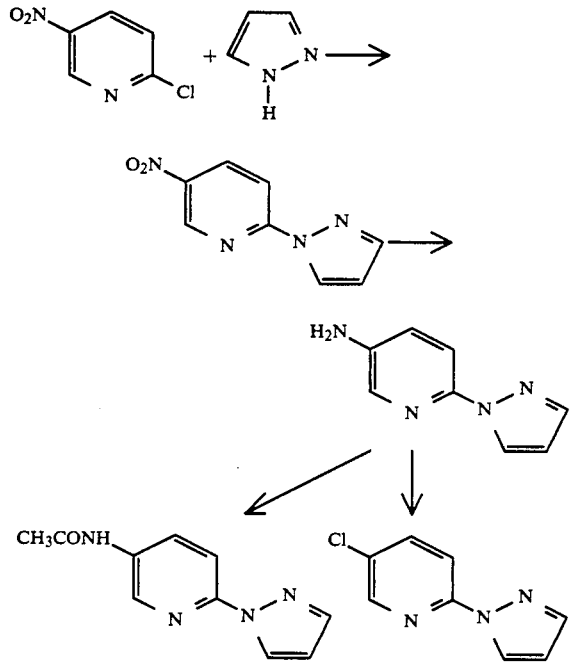

Scheme 3

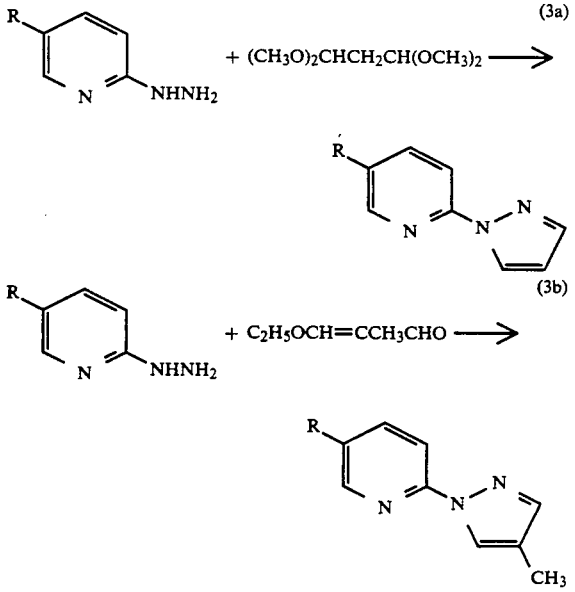

Scheme 4

-continued

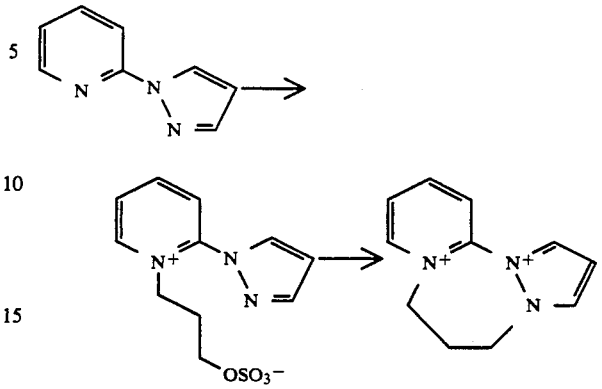

Scheme 1 involves the displacement of a halogen leaving group from an alkylated pyridine by a pyrazole followed by alkylation to give the dicationic product.

In Scheme 2 the halogen is activated by a nitro group towards displacement by the pyrazole group and the nitro group of the product can then be manipulated in standard ways to give the corresponding 5-chloro and 5-acetamido analogs. Thereafter, the products are N-alkylated to give the dicationic products.

In Scheme 3 the pyrazole ring is formed from the hydrazinopyridine by reaction with an appropriate 3-carbon bifunctional intermediate. These products are then N-alkylated to form the dicationic products.

Scheme 4 involves an intramolecular alkylation, which occurs during alkylation of zwitterionic pyrazoles with methyl triflate or during alkylation of pyrazolylpyridines with two equivalents of 1,3-propylenesulfate.

The compounds of formula (I) can be used to harden any type of gelatin, preferably alkali treated bone gelatin. Types of gelatin useful in the practice of the present invention include alkali-treated gelatin, acid-treated gelatin, partially phthalated gelatin, double-dipped gelatin (i.e., gelatin treated with both alkali and acid), and the like.

Compounds of formula (I) provide rapid hardening of gelatin with little or no after hardening while avoiding many of the adverse photographic effects found with prior art hardeners, such as speed loss and fog. In general, the hardening compounds of formula (I) also are not highly hygroscopic as are many prior art hardening compounds, thereby making them easy to handle. The hardening compounds of formula (I) also do not release halogen ion during their reaction with gelatin as do many prior art hardening compounds, thus avoiding the adverse photographic effects associated with the release of halogen ion. Additionally, gelatin hardened according to the invention exhibits desirable physical properties, such as low tackiness.

According to the present invention, gelatin is hardened by combining it with a hardening compound according to formula (I). This is accomplished by techniques known to those skilled in the art. For example, the aqueous solution of the hardening compound can be applied directly to an unhardened gelatin layer that has been coated on a support. Alternatively, the hardening compound can be mixed with the composition to be hardened shortly before coating it onto a support. Another way of using the compounds of formula (I) is to coat the compound in a gelatin or nongelatin (synthetic polymer) layer as an overcoat or as an internal layer of a photographic element in a manner such that it will diffuse into other layers of the element to harden those other layers.

The compounds of formula (I) according to the invention can also be used to partially harden gelatin. This is done, for example, by increasing the chain length of the gelatin, as described in U.S. Pat. No. 4,421,847.

The amount of hardener used to harden gelatin according to the present invention will vary according to the purpose of which the gelatin is being used, the degree of hardening desired, and the particular compound of formula (I) that is used. If only a slight amount of hardening is desired, relatively small amount of hardening compound can be used. If a greater degree of hardening is desired, relatively large amount of hardener would be used. The amount of hardener used according to the present invention is preferably between 0.01 and 20 weight percent, based on the weight of dry gelatin, and more preferably between 0.1 and 10 weight percent, based on the weight of dry gelatin.

The hardening compound of formula (I) that is used in the present invention can be used alone, in combination with another hardening compound according to formula (I), or in combination with any of a number of hardening compounds or hardening accelerators known in the art. Examples of known hardening compounds include formaldehyde and free dialdehydes, sulfonate esters, epoxides, blocked active olefins, and others, as described in *Research Disclosure*, Item 17643, December, 1978 [hereinafter referred to as *Research Disclosure I*], Section X. Examples of known hardening accelerators include aprotic solvents, as described in German OLS No. 2,417,586, tertiary amines and their salts, as described in British Pat. No. 1,269,983, and polyhydric alcohols.

The present invention is especially useful for hardening gelatin used in gelatin-containing layers in photographic elements. Such elements are well-known in the art. Examples of elements useful in the practice of the present invention include color negative film, color reversal film, color positive film, color print paper, color reversal print paper, black and white film, black and white paper, X-ray film, microfilm, and others well-known in the art. Color films and papers generally contain a red-sensitive silver halide layer, a blue-sensitive silver halide layer, and a green-sensitive silver halide layer. The redsensitive layer usually has a cyan dye-forming coupler associated therewith, the blue-sensitive layer usually has a yellow dye-forming coupler associated therewith, and the green-sensitive layer usually has a magenta dye-forming coupler associated therewith. The radiation sensitive layers have a silver halide emulsion. Such emulsion as known in the art consist of silver chloride, silver bromide, silver iodide, silver bromoiodide, and the like. The silver halide may be present in tabular grains.

Photographic elements with which the present invention is useful generally include, in addition to the above-described light-sensitive layers, various additional layers, such as filter layers, subbing layers, interlayers, antihalation layers, and the like, as described in *Research Disclosure I*. This Research Disclosure item also describes various addenda, such as surfactants and other coating aids, dye stabilizers, antifoggants, development inhibitor-releasing compounds, filter dyes, optical brighteners, antistatic compounds, and the like, that can be included in photographic elements useful in the present invention, either in separate layers or in any of the abovedescribed layers.

The gelatin-containing layers in photographic elements that are advantageously hardened by treatment with the compounds of formula (I) may utilize gelatin as the only binder in the layers, or the gelatin may be combined with other materials. Such materials include, for example, dispersions of water insoluble or slightly soluble polymers, vinyl alcohol polymers, halogenated styrene polymer, poly(sulfonic acid), poly(sulfinic acid), and others describe in detail in Research Disclosure I, Section IX In one preferred embodiment of the invention, compounds according to formula (I) where at least one of the $X^{\theta}$ ions is an anionic portion of the compound to form an intramolecular salt are advantageously utilized to harden gelatin compositions comprising gelatin and a negatively-charged hydrophobic dispersion. Such zwitterionic hardener compounds according to formula (I) have little adverse interaction with such dispersions.

This anionic portion of the compound can be a substituent on any of the R groups described above. Such anionic substituents are well-known in the art and include, for example, sulfato, sulfo, acyl sulfamoyl such as $SO_2NHCOR$ where R is alkyl of 1 to 6 carbon atoms such as methyl, ethyl, and the like, and phosphono such as $CH_2CH_2PO_3H_2$. In a preferred embodiment, $R_1$ and $R_2$ form a heterocyclic ring such as a pyridylium ring, $R_4$ and $R_5$ form a heterocyclic ring such as a pyridylium ring, and one of the $X^{\theta}$ anions may be a substituent on $R_3$ or $R_6$ and the other of the $X^{\theta}$ anions may be a substituent on the other $R_3$ or $R_6$.

The negatively-charged dispersion of hydrophobic addenda includes any dispersion of a hydrophobic compound or composition, solid or liquid, having negatively-charged particles or droplets with mean diameters ranging from about 0.02 μm to 1.0 μm. Hydrophobic compounds or compositions useful in the practice of the invention include photographic couplers such as dye-forming couplers as described, for example, in *Research Disclosure I*, Section VII, development modifier-releasing couplers such as those described, in U.S. Pat. No. 4,248,962 and *Research Disclosure I*, Section VII(F) optical brighteners such as those described in *Research Disclosure I*, Section V, ultraviolet absorbers such as those described in U.S. Pat. No. 4,195,999, oxidized developer scavengers such as those described in *Research Disclosure I*, Section VII(I) and U.S. Pat. No. Nos. 2,728,659 and 4,366,236, or combinations thereof.

The dispersion of hydrophobic addenda may be an oil-in-water type dispersion in which the hydrophobic addenda is a high-boiling water-insoluble organic liquid or is dissolved in a high-boiling water-insoluble organic solvent, such as dibutylphthalate, tricresyl phosphate, or diethyl lauramide. Such dispersions and techniques for preparing them are well-known in the art and are described, for example, in *Research Disclosure I*, Section XIV, U.S. Pat. No. No. 2,322,027, and James, *The Theory of the Photographic Process*, 4th, 348–51, 1977. The dispersion may also be a dispersion of solid particles as described, for example in *Research Disclosure*, Item 16468, December, 1977 and G. B. Pat. No. 1,193,349, the disclosures of which are incorporated herein by reference. The dispersion may also be a latex dispersion of particles of a polymer having the photographic addenda bonded thereto, such as polymeric as described in U.S. Pat. No. 4,612,278 and James, The Theory of the Photographic Process 4th, 347–48, 1977, the disclosures of which are incorporated herein by reference. Additionally, the dispersion may be a latex dispersion of polymer particles that may contain hydrophobic addenda, as described in *ResearcH Disclosure*, Item 19551, July, 1980, *Research Disclosure* Item 15930, July, 1977, and U.S. Pat. No. 4,304,769, the disclosures of which are incorporated herein by reference. The hydrophobic addenda that is dispersed may itself carry the negative charge instead of or in combination with an anionic surfactant. Such hydrophobes include micelle-forming couplers, which are known in the art. In a preferred embodiment, the hydrophobic dispersion is of a hydrophobic coupler in an oil in water type dispersion using a high-boiling water-insoluble organic solvent. The above dispersions and methods for preparing them are well-known in the art.

The droplets or particles of the dispersion of hydrophobic addenda are imparted with a negative charge through the use of a number of anionic surfactants that are well-known in the art. Anionic surfactants are described in *Research Disclosure I*, Section XI and *McCutcheons's Detergents and Emulsifiers*, Allured Publishing Corp., 1973, the disclosures of which are incorporated herein by reference. Such surfactants generally have a hydrophobic portion (preferably of 8 to 25 carbon atoms) appended to at least one anionic group, such as sulfo or sulfato. The hydrophobic portion is believed to associate with the hydrophobic particles or droplets in the dispersion such that the anionic group(s) appended thereto impart a negative charge to the dispersion particles or droplets. Examples of such surfactants include:

| Compound |
|---|
| 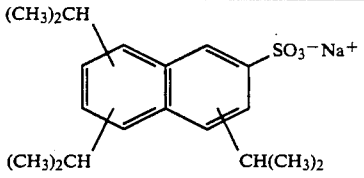 S-1 |
| 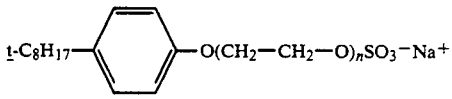 (n = 2–4) S-2 |
| 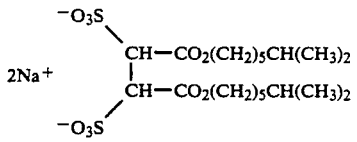 S-3 |
| 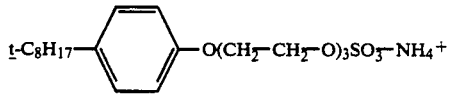 S-4 |

The invention is further described in the following examples.

EXPERIMENTAL

All melting points were uncorrected. Where applicable the NMR spectra were determined on a QE 300 spectrometer and were in accord with the assigned structures. IR spectra were obtained with a Perkin Elmer 710B spectrophotometer.

SYNTHESIS EXAMPLE 1 (Compound 2)

2-(1-Imidazolyl)-1-methylpyridinium iodide

2-Chloro-1-methylpyridinium iodide (9.43 g), imidazole (2.45 g) and diisopropylethylamine (4.77 g) were added to acetonitrile (150 ml) and the mixture refluxed for 2 hours. The product was filtered off from the chilled solution and dried. Yield, 6 g.

2-(3-Methyl-1-imidazolio)-1-methylpyridinium di-p-toluenesulfonate (Compound 2)

The above imidazolo compound (0.5 g) and methyl p-toluenesulfonate (2 g) were heated together at 180° C. for two minutes. The melt was cooled and isopropyl alcohol added. The product separated and was filtered off and recrystallized from isopropyl alcohol. Yield, 0.4 g; mp 126°–128° C.

SYNTHESIS EXAMPLE 2 (Compound 1)

1-methyl-2-(1-pyrazolyl)pyridinium iodide

2-Chloro-1-methylpyridinium iodide (5.0 g), pyrazole (1.3 g) and diisopropylethylamine (2.5 g) were added to acetonitrile (50 ml) and the mixture refluxed for 3.5 hours. The acetonitrile was removed and the residue dissolved in hot ethanol. The solution was left in the refrigerator overnight. The product was collected by filtration Yield, 1.73 g; mp 129°–130° C.

1-methyl-2-(2-methyl-1-pyrazolio)pyridinium di-p-toluene sulfonate (Compound 1)

The pyridinium salt (1.4 g) and methyl ptoluene sulfonate (2.72 g) were heated in a xylene bath at 140° C. for one hour. The reaction mixture was cooled and dissolved in ethanol. Addition of ether precipitated the product which was then filtered off. Yield, 0.8 g; mp 185°–186° C.

SYNTHESIS EXAMPLE 3 (Compound 8)

1-methyl-2-(2-methyl-1-pyrazolio)pyridinium bis(tetrafluoborate) (Compound 8)

2-Chloropyridine (11.3 g) was dissolved in acetonitrile (20 ml) and methyl sulfate (13.5 g) added. The solution was refluxed for 16 hours. After cooling, pyrazole (6.8 g) was added followed by triethylamine (10.2 g) and the solution refluxed for 4 hours. It was then cooled and filtered to remove some triethylamine salt. Methyl sulfate (13.8 g) was added and the solution reluxed for 16 hours. At the end of this time the solvent was removed and a filtered solution of $NaBF_4$ (22 g) in water (50 ml) was added. After chilling in the refrigerator the product was filtered off. Yield, 13 g; mp >290° C.

SYNTHESIS EXAMPLE 4 (Compound 9)

anhydro 2-chloro-1-(3-sulfatopropyl)pyridinium hydroxide

2-Chloropyridine (50 g) was dissolved in nitromethane (50 ml) and 1,3-propylene sulfate (61 g) was added. The reaction mixture was heated on the steam bath for 8 hours and then concentrated. The oil was stirred in ethanol (21 ml) until crystallization occurred. The product wqas filtered off and dried in the oven at 50° C. Yield, 60.5 g, mp 171°–174° C.

anhydro 2-(1-pyrazolyl)-1-(3-sulfatopropyl)pyridinium hydroxide

The above chloropyridinium salt (5 g), pyrazole (1.3 g), and triethylamine (2 g) were added to acetonitrile (40 ml) and refluxed for 4 hours. The reaction mixture was cooled and filtered. The product was purified by recrystallization from hot acetonitrile. Yield, 2.31 g; mp 193°-195° C.

11,12-dihydro-10H-pyrazolo[2,1-a]pyrido[2',1',-c]1,2,4-triazepin-9,13-dium bis(tetrafluoborate) (Compound 9)

Anhydro 2-(1-pyrazolyl)-1-(3-sulfatopropyl)-pyridinium hydroxide (2 g) and methyltriflate (1.3 g) were added to nitromethane (10 ml) and carbon tetrachloride (10 ml) and the mixture was refluxed for 4 hours. The crude product was drowned out by the addition of ether. The ether was decanted and the oil dissolved in water (10 ml). A filtered solution of sodium fluoborate (1.39 g) in water (4 ml) was then added with stirring. The product was filtered off and recrystallized from water. Yield, 0.9 g; mp >275° C.

SYNTHESIS EXAMPLE 5 (Compound 3)

anhydro-2-(1,2,4-triazol-1-yl)-1-(2-sulfatoethyl)-pyridinium hydroxide 1H-1,2,4-Triazole (2.9 g), anhydro 2-chloro-1-(2-sulfatoethyl)pyridinium hydroxide (10 g) and diisopropylethylamine (5.4 g) were dissolved in acetonitrile (100 ml) ansd the solution refluxed overnight. The reaction mixture was filtered hot. Yield, 9.27 g; mp 213°-218° C.

anhydro-2-[4-methyl-1-(1,2,4-triazolio)]-1-(2-sulfatoethyl)pyridinium hydroxide trifluoromethanesulfonate (Compound 3)

The above pyridinium salt (1.0 g) was added to a mixture of nitormethane (5 ml) and carbon tetrachloride (5 ml). Methyl triflate (0.66 g) was added and the mixture refluxed for 3.5 hours. The solution was cooled and the product isolated by filtration. It was purified by stirring in hot methanol followed by filtration. Yield, 1.1 g; mp 193°-195° C.

COATING EXAMPLE 1

A test material was prepared by coating a layer containing a mixture of gelatin at a level of 900 mg/ft$^2$ and colloidal silver at a level of 45 mg/ft$^2$ onto an Estar® film base. The coated film base was cut into a series of test strips that were immersed in an aqueous solution of hardening compounds of Formula (I) from Table I and comparison hardening compounds shown in Table II. The concentration of the solution into which the coatings were immersed was 14.29 mmolar with respect to the hardening compound, which based on a swell of 8 times the original volume resulted in an uptake of 10 mmoles of compound per 100 grams of gelatin. The strip was immersed for 5 minutes, excess solution on the surface of the coating was removed by passing the strip between the nip of a roller set (one stainless steel and the other rubber), and air-drying the strip at 50° C. for 5 minutes.

An important physical characteristic of a photographic coating is its vertical swell when it is wetted. The vertical swell is commonly equated to the term "hardness." Vertical swell relates to the rate that processing chemicals can diffuse through a coating and, therefore, the rate of processing. It also relates to the abrasion resistance of a coating in the wetted state.

The vertical swell (or "hardness") of the coatings in the EXAMPLE 1 was measured using a mechanical device that has the ability to precisely measure thickness. The degree of afterhardening was determined by comparing the coating hardness, as measured by vertical swell, of the coating shortly after it was prepared to the hardness of the coating after it had aged, as indicated in the parentheses in Table III. The swell measurement consisted of measuring the change in thickness of the strip when it was wetted with distilled water at 20° C. The change in thickness after a 5 minute wetting time was used to calculate the x-swell of the coating. X-swell was calculated by dividing the measured coating swell (change in thickness from the dry to wet state) by the calculated dry thickness based only on gelatin coverage and assuming a gelatin density of 1 g/cm$^3$. Using the gelatin coverage of 900 mg/ft$^2$, the formula used to calculate x-swell was the following.

$$\text{x-swell} = [\text{mils of swell}]/[(0.9\ \text{g/ft}^2)(0.423776\ \text{mils/g/ft}^2)]$$

Compounds known in the art to be gelatin hardeners are listed in Table II. These compounds were coated by the above procedure for comparison with the compounds of the invention.

TABLE II

| Compound | Structure |
|---|---|
| CH-1 | 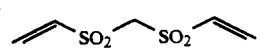 |
| CH-2 | 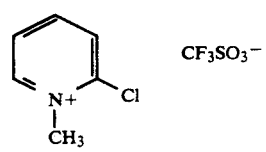 |
| CH-3 | 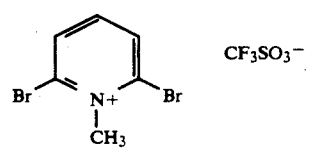 |
| CH-4 | 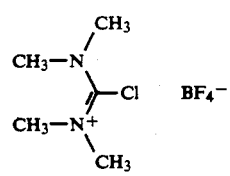 |
| CH-5 | 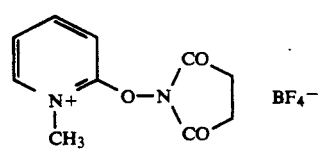 |
| CH-6 | 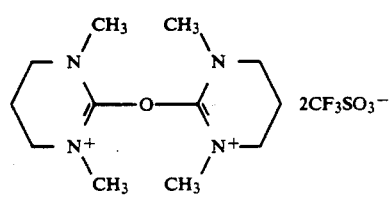 |

TABLE II-continued

| Compound | Structure |
|---|---|
| CH-7 | 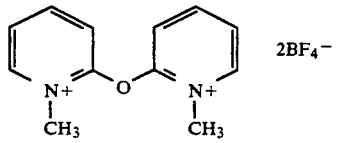 |

The results of this test are shown in Table III.

TABLE III

| Compound | x-swell 1st measurement (age)[a] | x-swell 2nd measurement (age)[a] |
|---|---|---|
| none | 8.12 | |
| CH-1 | 4.56 (4 h amb.) | 1.60 (1 d 25° C./ 80% RH) |
| CH-2 | 1.87 (4 h amb.) | 1.40 (1 d 25° C./ 80% RH) |
| CH-3 | 1.93 (4 h amb.) | 1.75 (1 d 25° C./ 80% RH) |
| CH-4 | 1.82 (18 h amb.) | 1.80 (1 d 25° C./ 80% RH) |
| CH-5 | 2.98 (1 d 25° C./ 80% RH) | — |
| CH-6 | 1.23 (2 d 25° C./ 80% RH) | — |
| CH-7 | 1.79 (2 h amb.) | 1.78 (12 d amb.) |
| (1) | 1.94 (1 d amb.) | 1.98 (2 d amb.) |
| (2) | 2.55 (1 d amb.) | 2.26 (2 d amb.) |
| (3) | 3.27 (1 d amb.) | 3.12 (2 d amb.) |
| (4) | 2.30 (1 d amb.) | 2.34 (2 d amb.) |
| (5) | 2.34 (1 d amb.) | 2.26 (2 d amb.) |
| (6) | 4.48 (3 h amb.) | — |
| (7) | 1.89 (1 d 25° C./ 80% RH) | — |
| (8) | 2.09 (2 h amb.) | 1.80 (1 d 25° C./ 80% RH) |
| (9) | 2.41 (4 h amb.) | 2.15 (20 h amb.) |
| (10) | 1.77 (2 h amb.) | 1.66 (16 h amb.) |
| (11) | 2.00 (4 h amb.) | 1.67 (1 d 25° C./ 80% RH) |
| (12) | 3.85 (4 h amb.) | 2.38 (1 d 25° C./ 80% RH) |
| (13) | 2.56 (4 h amb.) | 2.39 (1 d 25° C./ 80% RH) |
| (14) | 2.77 (4 h amb.) | 2.43 (1 d 25° C./ 80% RH) |
| (15) | 2.47 (20 h amb.) | 1.94 (1 d 25° C./ 80% RH) |
| (16) | 2.60 (20 d amb.) | — |
| (17) | 1.80 (1.4 h amb.) | 1.67 (1 d 25° C./ 80% RH) |

[a]h = hours, amb. = ambient conditions (approximately 23° C., 50% relative humidity), d = days, RH = relative humidity Table III shows that coatings overcoated with the compounds of this invention had a lower swell than the coating that was overcoated with only water, indicating that these compounds are useful gelatin hardeners. Compounds of the invention resulted in little or no afterhardening while compound CH-1 showed significant afterhardening, as indicated by the difference between the x-swell of the fresh and aged coatings. None of the coatings that were overcoated with the compounds of the invention were tacky. None of these compounds of the invention release halide ion upon reaction with gelatin while compounds CH-2, CH-3, and CH-4 release halide upon reaction with gelatin. None of the compounds of the invention are hygroscopic while compounds CH-2, CH-3, and CH-4 are hygroscopic.

This invention has been described with particular reference to preferred embodiments thereof. A skilled practitioner familiar with the above detailed description can make many substitutions and additions without departing from the scope and the spirit of the attached claims.

What is claimed is:

1. A method for hardening gelatin, comprising reacting gelatin and a compound of the formula:

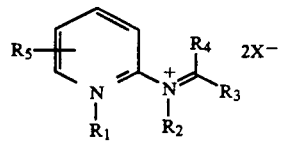

wherein $R_1$, when taken alone, is selected from alkyl groups of 1 to 20 carbon atoms, aryl groups of from 6 to about 20 carbon atoms, aralkyl groups of from 7 to about 20 carbon atoms, or alkenyl groups of from 2 to about 20 carbon atoms; $R_1$ when taken together with $R_2$ form a heterocyclic ring of 5 to 8 atoms, which may include one nitrogen in addition to the two nitrogen atoms in said formula; $R_2$ and $R_3$ together form a 5 or 6 membered ring which may include one or two nitrogen atoms in addition to the nitrogen to which $R_2$ is attached; such that the above-described $R_1$–$R_2$ and $R_2$–$R_3$ ring atoms other than nitrogens are carbons; $R_4$ is selected from hydrogen or alkyl groups of from 1 to about 20 carbon atoms; $R_5$ is selected from hydrogen or one or more substituents at any of positions 3 through 6 on the pyridine ring, selected from the group consisting of alkyl of from 1 to about 20 carbon atoms, aryl of from 6 to about 20 carbon atoms, aralkyl of from 7 to about 20 carbon atoms, or alkenyl of from 2 to about 20 carbon atoms, alkoxy of from 1 to about 20 carbon atoms, aryloxy of from 6 to about 20 carbon atoms, carboxy, halogen, nitro, and sulfo; and $X^-$ represents an inert anion or an anionic portion of said compound, forming an intramolecular salt, with the proviso that the anion or anionic portion does not interfere with the hardening process.

2. Gelatin hardened with a compound having the formula

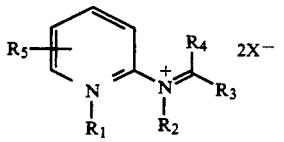

wherein $R_1$, when taken alone, is selected from alkyl groups of 1 to 20 carbon atoms, aryl groups of from 6 to about 20 carbon atoms, aralkyl groups of from 7 to about 20 carbon atoms, or alkenyl groups of from 2 to about 20 carbon atoms; $R_1$ when taken together with $R_2$ form a heterocyclic ring of 5 to 8 atoms, which may include one nitrogen in addition to the two nitrogen atoms in said formula; $R_2$ and $R_3$ together form a 5 or 6 membered ring which may include one or two nitrogen atoms in addition to the nitrogen to which $R_2$ is attached; such that the above-described $R_1$–$R_2$ and $R_2$–$R_3$ ring atoms other than nitrogens are carbons; $R_4$ is selected from hydrogen or alkyl groups of from 1 to about 20 carbon atoms; $R_5$ is selected from hydrogen or one or more substituents at any of positions 3 through 6 on the pyridine ring, selected from the group consisting of alkyl of from 1 to about 20 carbon atoms, aryl of from 6 to about 20 carbon atoms, aralkyl of from 7 to about 20 carbon atoms, or alkenyl of from 2 to about 20 carbon atoms, alkoxy of from 1 to about 20 carbon atoms, aryloxy of from 6 to about 20 carbon atoms, carboxy, halogen, nitro, and sulfo; and $X^-$ represents an inert anion or an anionic portion of said compound, forming an intramolecular salt, with the proviso that the anion or anionic portion does not interfere with the hardening process.

3. A composition according to claim 2 which additionally contains a silver halide.

4. A photographic element comprising a support having thereon a layer comprising a composition according to claim 3.

* * * * *